United States Patent [19]

Arild et al.

[11] 4,042,114

[45] Aug. 16, 1977

[54] FEED WHEEL FOR A SORTING APPARATUS

[75] Inventors: Tor Arild, Woodside; Russell R. Ames, San Jose, both of Calif.

[73] Assignee: Accusort Corporation, Belmont, Calif.

[21] Appl. No.: 687,981

[22] Filed: May 19, 1976

[51] Int. Cl.[2] ..... B07C 5/344

[52] U.S. Cl. ..... 209/111.7 R; 221/277

[58] Field of Search ..... 221/277; 222/369; 209/111.7 R, 111.7 T, 111.6, 111.5, 120

[56] References Cited

U.S. PATENT DOCUMENTS

| | | | |
|---|---|---|---|
| 2,111,485 | 3/1938 | Boykin | 222/369 X |
| 2,295,380 | 9/1942 | Bland | 222/369 |
| 3,380,586 | 4/1968 | Frobese et al. | 209/111.6 |

*Primary Examiner*—Allen N. Knowles

*Attorney, Agent, or Firm*—Limbach, Limbach & Sutton

[57] ABSTRACT

A feed wheel for use in sorting apparatus for feeding beans or other similar articles to be sorted in single file into a viewing head in which the objects are optically examined to detect those of undesirable quality or characteristics. This feed wheel is provided with two disc members that are supported in spaced relation by a hub that may be readily disassembled. Peripheral portions of the disc members are provided with inwardly projecting flanges for gripping and supporting a plurality of small scoops extending around the circumference of the disc members. A plurality of locking devices are provided to the disc members for holding the disc members clamped against the scoops so that said scoops can be removed and replaced only when the locking members are disengaged. Several of the feed wheels may be mounted on a rotatable shaft and rotated at a selected speed through a supply of beans or other articles to be sorted so that the scoops each pick up one of such articles which are then projected in single file through the sorting apparatus viewing head.

12 Claims, 8 Drawing Figures

FEED WHEEL FOR A SORTING APPARATUS

CROSS-REFERENCES TO RELATED APPLICATIONS

Ser. No. 687,949, filed on the same day as the present application, entitled: CONTROL FOR A SORTING APPARATUS, William F. Marshall and Tor Arild, and assigned to the same assignee as the present invention. Ser. No. 687,950, filed on the same day as the present application, entitled: LIGHT DETECTING HEAD FOR SORTING APPARATUS, Tor Arild and Russell R. Ames, and assigned to the same assignee as the present invention.

Each of said related applications are hereby incorporated herein by reference in their entirety.

DISCUSSION OF THE PRIOR ART

Heretofore various feed wheels have been constructed for feeding beans and other articles into sorting machines designed to perform sorting operations. However, the various prior feed wheel designs with which we are familiar are either difficult or expensive to manufacture or they do not lend themselves to be readily adjusted or converted for feeding articles of different sizes to be sorted.

Therefore an object of this invention is to provide an improved feed wheel construction which may be economically manufactured and which is adapted to be readily disassembled for servicing or for changing the article-receiving scoops provided thereto.

Another object of this invention is to provide an improved feed wheel for use in feeding beans or other articles to be sorted single file through a sorting apparatus, said feed wheel being provided with two disc members which are held in spaced relation by a hub that may be readily disassembled so that the disc members may be taken apart, said disc members being provided with additional locking devices located adjacent to a series of article-receiving scoops that are held by the disc members projecting from the circumference thereof, said scoops being clamped between said disc members by said locking devices.

SUMMARY OF THE INVENTION

An article feed wheel for use in feeding beans or other articles in single file in a sorting machine. The construction of the feed wheel is such that it may be readily removed from its support and provided with article-receiving scoops of different shapes or configurations so that the feed wheel may be used for feeding beans or other articles of different sizes. Also the feed wheel may be readily taken apart so that any of the scoops that are worn out or broken in use may be readily replaced without it being necessary to discard the entire wheel.

DESCRIPTION OF THE PREFERRED EMBODIMENTS

Figure 1:
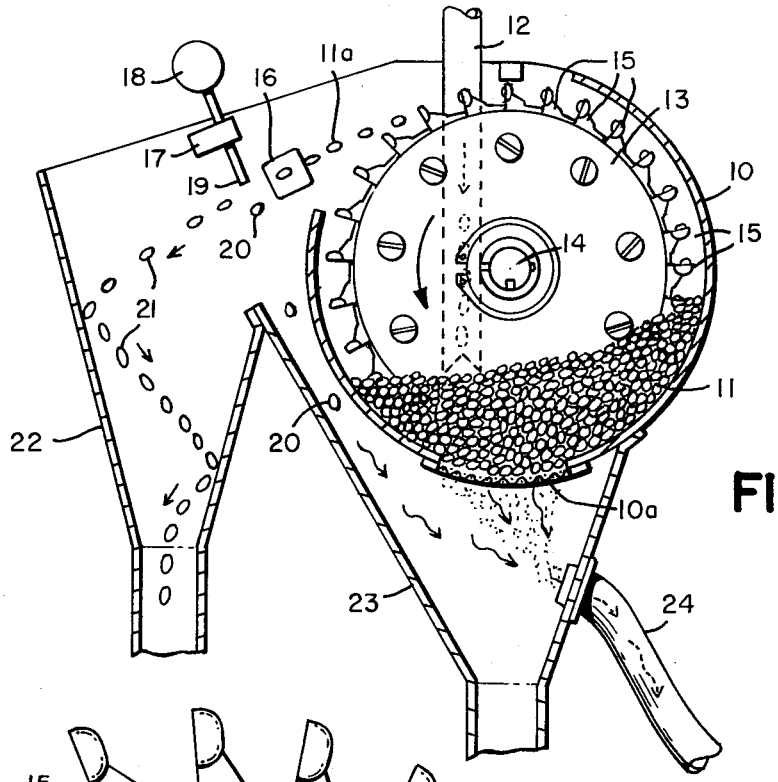
FIG. 1 is a vertical sectional view showing the feed wheel mounted in a bin receiving beans or other articles to be sorted in which the feed wheel picks up the articles to be sorted and projects these in a single file through the viewing head of the sorting apparatus.

Referring to the drawings in detail, reference numeral 10 designates a housing or bin into which a supply of beans or similar particle material 11 is fed through a feed tube 12. A feed wheel 13 which is mounted on the shaft 14 is rotated by said shaft so that this wheel dips into the quantity of beans or other similar material 11 and feeds the beans out of the housing or bin 10 in an airborne single file stream as indicated at **11*a*, past viewing head 16. A plurality of feed wheels such as indicated at 13 may be attached to the shaft 14,** positioned in parallel relationship and rotated by said shaft so that a plurality of streams of beans are projected from the bin past different viewing heads.

The shaft 14 is driven by a suitable motor (not shown) which is coupled to the shaft by a suitable driving arrangement so that the feed wheels are driven at a selected speed such as 78 rpm which may be adjustable as desired so that the stream of airborne beans **11*a* is substantially horizontal and is projected into a photoelectric cell viewing head 16. The cells in the viewing head 16 are connected to an electronic circuit such as disclosed in the previously described application Ser. No. 687,949. This circuit functions to detect the undesired beans of poor quality or foreign particles that may be in the stream 11*a* preferably by detection of reflected light from the beans. The circuit then generates an electrical signal which is supplied to the solenoid valve 17 so that compressed air from a reservoir 18 is supplied to a nozzle 19 to deflect the rejected particle 20 down into a channel member 23. The desired particles in the stream of selected particles 21 proceed down a funnel shaped tube 22.**

The rejected beans or particles 20 fall down the channel member 23 to which a suction tube 24 is connected. The suction tube 24 is connected to a source of suction of conventional construction (not shown) and is used for drawing dust and similar particles out of the housing 10 through the screen **10*a* which is positioned in the bottom of the bin. Also the suction tube 24 draws dust out of the upper part of the channel member 23 and 22, however, this suction is not strong enough to deflect the beans in the streams 11*a* and 21** from their projected courses.

Figure 2:
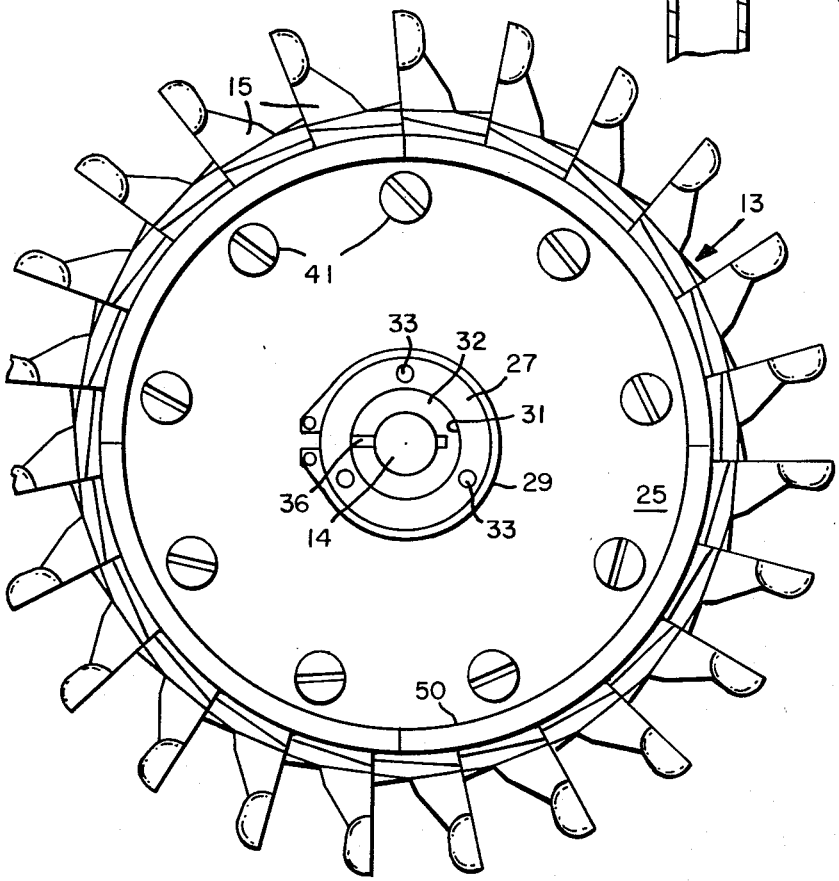
FIG. 2 is a view showing one side of the feed wheel of this invention.
Figure 7:
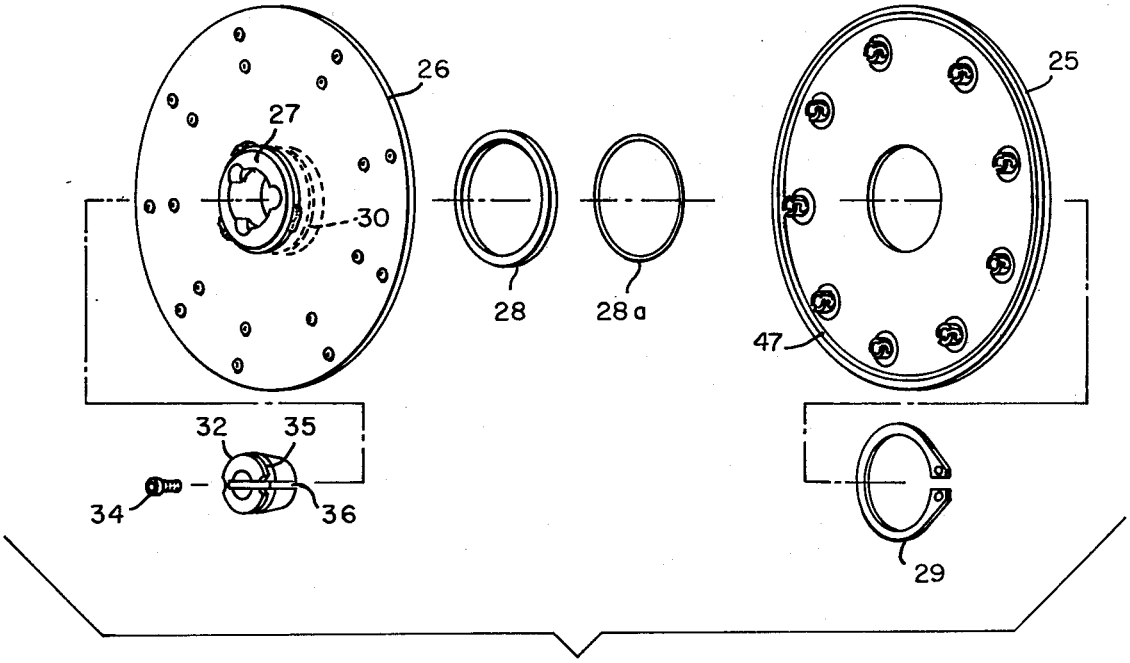
FIG. 7 is an exploded view of the feed wheel shown in FIG. 2.

In FIGS. 2 through 7 is shown one of the feed wheels 13. This feed wheel is constructed of two disc members 25 and 26 which are illustrated primarily in FIGS. 5, 6 and 7. The front side of member 25 is shown in FIG. 2 and the outside of rear disc member 26 is shown in FIG. 7. The hub 27 is attached to the rear side member 26 by welding or the like, as shown in FIG. 7. The hub 27 is provided with a ring 28 and an O-ring **28*a* is positioned between this ring 28 and the disc member 25 which is held on the hub 27 by the spring retaining member 39 that is snapped into the groove 30** formed on the outside surface of the hub.

Extending through the hub 27 is a slightly tapered hole 31 which receives a fitting 32. The hub 27 is also provided with three holes 33 which are threaded to receive the screws 34 that engage the shoulder 35 of the fitting 32 to draw this fitting into the tapered hole 31 and cause it to grip the shaft 14. The fitting 32 includes a slot 36 which permits the fitting to compress slightly as it is drawn into the tapered hole 31 and thereby grip the shaft 14 firmly to provide a frictional engagement so the feed wheel will rotate with the driven shaft.

The rear disc member 26 is provided with a plurality of foam rubber or foam plastic pads 40 that are glued or cemented by a suitable adhesive to the inner surface of this member. These pads on disc member 26 engage the inner surface of the member 25 when the disc members are assembled and are somewhat compressed. The disc members 25 and 26 are held in assembled relation by a plurality of locking members 41 of conventional construction. The locking members 41 are rotatably supported in holes formed in the disc member 25 and preferably can be turned one-quarter turn to grip the spring members 42 that are attached to the rear member 26. The disc members 25 and 26 are drawn toward each other by the locking members 41 and spring members 42 so that pads 40 are compressed slightly and at the same time the scoops 15 are clamped between the assembled disc members 25 and 26. Release of the locking members allows the disc members to move apart slighlty for removal and changing the scoop assembly as will be explained later.

The locking members 41 are held assembled with the member 25 by plastic washers 43 which are lodged in holes formed in the member 25 to frictionally grip the locking members. The locking members 41 are each provided with suitable recesses of arcuate shape which grip the spring members 42. Each locking member 41 is provided with a slot for receiving a suitable tool such as a screwdriver so that the locking member may be turned a partial turn and locked on the associated spring. Each of the spring members 42 is attached to the rear disc member 26 by a pair of rivets 46 so that these spring members are permanently fastened to the member 26.

Figure 3:
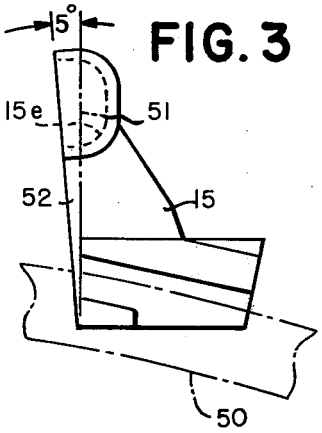
FIG. 3 is a side view of one of the scoops provided to the feed wheel shown in FIG. 2.
Figure 4:
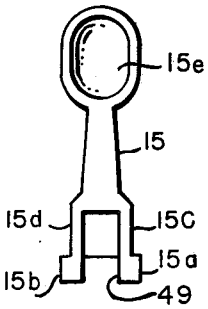
FIG. 4 is a front view of the scoop shown in FIG. 3.
Figure 3A:
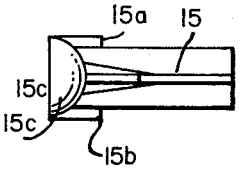
Figure 5:
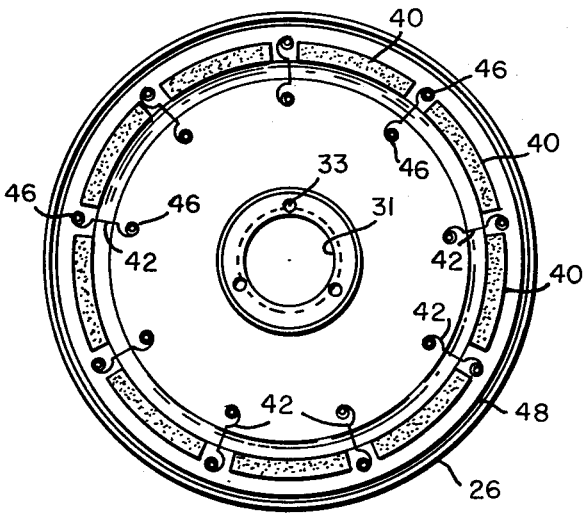
FIG. 5 is a view showing the inside of one of the disc members of the feed wheel.
Figure 6:
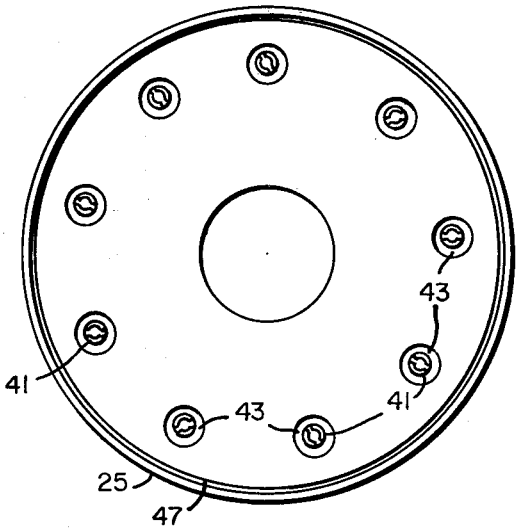
FIG. 6 is a view showing the inside of the other of the disc members of the feed wheel.

Members 25 and 26 are provided with grooves 47 and 48, respectively, which are formed on the inside surfaces thereof adjacent to the peripheries of these members to receive the small shoulders 15*a* and 15*b*, respectively, on opposite sides of the scoops 15. The disc members 25 and 26 have small flanges extending inwardly and positioned radially outward from the grooves 47 and 48, respectively, and these small flanges clamp against the side portions 15*c* and 15*d*, respectively, of the scoops 15 when these scoops are assembled between the disc members 25 and 26. The scoops themselves each preferably include an inwardly facing groove 49 (FIG. 4) which receives a segmented ring member 50 (FIGS. 2 and 3). The ring member may be segmented, say into 120° sections, such that three are used for a total 360° scoop assembly. The scoops may be cemented onto the ring member segments for ease of handling. Thus, when the scoops 15 mounted on the ring segments are positioned around the inside periphery of the disc members 25 and 26 and these members are securely locked together by the locking members 41 engaging the spring members 42, scoops 15 are held securely fastened to the disc members. With further reference to FIGS. 2 and 3, the scoops 15 preferably are tilted forward approximately 5° from a radial line 51 extending through the axis of the support of the shaft 14. Positioning of the scoop is achieved by the proper canting of the channel 49 relative to the scoop 15. The scoop itself comprises an arm 52 with the bowl 54 held at the outer end. This bowl includes the recess 15*e*.

Each scoop recess or hollow 15*e* in front thereof is sized for receiving one of the beans or other particles 11 as the scoops are rotated through the particle supply shown in FIG. 1. The beans or particles are carried by the scoops 15 upward and then thrown therefrom to form the airborne bean or particle stream 11*a* as shown in FIG. 1. For a proper grouping of the beans or particles, in the stream 11*a*, there must be a close control over certain parameters of the feed wheel. For a scoop having the bowl tilted forward approximately 5°, and with a recess formed as shown in the drawings, it has been found satisfactory to drive the feed wheel at a rotational velocity sufficient to give the bowl a velocity of approximately 254 feet per minute. Such a velocity has been found to throw the beans in a very small cross-sectioned stream past the viewing head 16. The forward tipping of the head has also been found to enhance the predictability of where the bean will leave the feed wheel thereby also making the path 11*a* much smaller in cross-section.

Scoops 15 are preferably molded from a polycarbonate, such as General Electric "Lexan" or its equivalent. Such materials provide economical fabrication and exhibit good wear characteristics in operation.

We claim:

1. A feed wheel for use in apparatus for sorting small particles, such as beans, comprising the combination of a pair of disc members, a hub, one of said members being attached to said hub, means detachably supporting the other of said members on said hub, said members being positioned on said hub in parallel spaced relation, a plurality of particle-receiving scoops each having attaching means which when the scoop is positioned between peripheral portions of said disc members will engage said disc members and releasable locking means for clamping and locking said peripheral portions of said disc members to releasably hold said scoops.

2. A feed wheel for use in apparatus for sorting small particles, such as beans, the combination as set forth in claim 1, further comprising resilient means positioned between said disc members urging said peripheral portions apart to release said scoops when said locking means is released.

3. A feed wheel for use in apparatus for sorting small particles, such as beans, the combination as set forth in claim 1, further characterized in that said locking means comprises a plurality of rotatable latching devices, means supporting said latching devices on one of said disc members and means engaging said latching devices supported on the other of said disc members.

4. A feed wheel for use in apparatus for sorting small particles, such as beans, the combination as set forth in claim 1, further characterized in that said disc members have opposing flanges and said attaching means of said scoops includes disc recesses for receiving said flanges.

5. A feed wheel for use in apparatus for sorting small particles, such a beans, comprising the combination of a pair of disc members, a hub, one of said members being attached to said hub, means detachably supporting the other of said members on said hub, said members being positioned on said hub in parallel spaced relationship, a plurality of particle receiving scoops, said disc members having means gripping and holding said scoops in a position to extend from peripheral portions of said disc members, releasable locking means attached to said disc members adjacent to said peripheral portions, said locking means holding said gripping means of said disc members against said scoops.

6. A feed wheel for use in apparatus for sorting small particles, such as beans, the combination as set forth in claim 5, further characterized in that said gripping means comprises inwardly turned flanges gripping said scoops therebetween.

7. A feed wheel for use in apparatus for sorting small particles, such as beans, comprising the combination of a hub, a plurality of scoops each having a bowl with a recess therein shaped to receive substantially one small particle, means for mounting the scoops for rotation about the hub, a reservoir for holding a quantity of small particles so the scoops will pass therethrough and each will pick up one small particle in the recess, said scoops' bowl being tilted forward slightly from a radial line passing through the scoop bowl and the axis of the hub such that the beans will be ejected from the recess along a single file stream tangential to the circular path of the scoops.

8. A feed wheel for use in apparatus for sorting small particles such as beans, comprising the combination recited in claim 7 and further characterized in that the forward tilt of the bowl is approximately 5° from the radial line.

9. A feed wheel for use in apparatus for sorting small particles such as beans, comprising the combination recited in claim 8 and further characterized in that the hub is rotated a speed sufficient to cause movement of the scoops at a velocity of approximately 254 feet per minute.

10. A feed wheel for use in apparatus for sorting small particles, such as beans, comprising the combination set forth in claim 7 and further characterized in that the means for mounting the scoops for rotation about the hub comprises a pair of disc members adapted to be fixed for rotation with the hub, and including releasable means for receiving the scoops between the outer edges thereof.

11. A feed wheel for use in apparatus for sorting small particles, such as beans, comprising the combination set forth in claim 10 wherein the scoops are mounted on rings and the combination of the ring and the mounted scoops are releasably attached to the disc members.

12. A feed wheel for use in apparatus for sorting particles, such as beans, as defined in claim 7 in combination with means to measure a property of each small particle in the stream and means to separate those small particles in the stream having properties differing from the other small particles.

* * * * *